US006126408A

United States Patent [19]

Murakami et al.

[11] Patent Number: 6,126,408

[45] Date of Patent: Oct. 3, 2000

[54] SINGLE-ENDED SWASH PLATE COMPRESSOR

[75] Inventors: Kazuo Murakami; Toshiro Fujii; Takayuki Imai; Tatsuya Koide, all of Aichi-ken, Japan

[73] Assignee: Kabushiki Kaisha Toyoda Jidoshokki Seisakusho, Kariya, Japan

[21] Appl. No.: 09/203,470

[22] Filed: Dec. 2, 1998

[30] Foreign Application Priority Data

Dec. 10, 1997 [JP] Japan ..... 9-340206

[51] Int. Cl.[7] ..... F01B 3/02; F04B 1/12; F04B 27/08

[52] U.S. Cl. ..... 417/269; 92/71

[58] Field of Search ..... 417/222.1, 269, 417/314; 92/71

[56] References Cited

U.S. PATENT DOCUMENTS

| | | | |
|---|---|---|---|
| 4,425,837 | 1/1984 | Livesay | 417/269 |
| 4,950,132 | 8/1990 | Brian, Jr. et al. | 417/269 |
| 5,461,967 | 10/1995 | Burkett et al. | 417/269 |
| 5,596,920 | 1/1997 | Umemura et al. | 417/269 |
| 5,771,775 | 6/1998 | Ota et al. | 417/269 |
| 5,868,556 | 2/1999 | Umemura | 417/269 |

FOREIGN PATENT DOCUMENTS

| | | |
|---|---|---|
| 5-26171 | 2/1993 | Japan . |
| 601669 A5 | 7/1978 | Switzerland . |
| 1 501 471 | 2/1978 | United Kingdom . |

*Primary Examiner*—Willis R. Wolfe
*Attorney, Agent, or Firm*—Morgan & Finnegan, L.L.P.

[57] ABSTRACT

In a single-ended swash plate compressor, in which pistons are guided at both ends, the side clearance between the pistons and the cylinder bores on the guide side is made larger than the side clearance between the pistons and the said cylinder bores on the compression side. Preferably, this is approximately 2 to 10 times, that is approximately 10 to 100 $\mu$m larger, or more preferably, 7 times larger.

8 Claims, 3 Drawing Sheets

SINGLE-ENDED SWASH PLATE COMPRESSOR

BACKGROUND OF THE INVENTION

1. Field of the Invention

The present invention relates to a single-ended swash plate compressor for use in automotive vehicle and like and in particular to a single-ended swash plate compressor which guides the piston at both the front a nd rear ends.

2. Description of the Related Art

Swash plate compressors, in which a plurality of cylinder bores are disposed parallel to a drive shaft in a peripheral portion of a cylinder block, with piston assemblies housed in the cylinder bores, the piston assemblies being caused to reciprocated by a swash plate which rotates together with the drive shaft, so as to compress a refrigerant gas, are in general use as compressors for conventional automotive air-conditioners. Moreover, double-ended swash plate compressors, which include double-headed piston assemblies in which compression pistons are formed on both ends of the piston rods and a compression action is performed at both the front end and the rear end of the piston bores, are often used. However, when using carbon dioxide ($CO_2$) as a refrigerant in order to avoid using chlorofluorocarbons, there is a tendency to use single-ended swash plate compressors. In general, conventional single-ended swash plate compressors include single-headed piston assemblies in which compression pistons are formed on one end of the piston rods only and the compression action is performed at one end of the piston bores, for example, the rear end only, but recently methods have been developed to reduce misalignment of the axes between the piston assemblies and the cylinder bores in which guide pistons are formed at the other end of the piston rods and the piston assemblies are supported at both the front and rear ends, that is, by both the guide pistons and the compression pistons.

FIG. 4 is a partial cross-section of the vicinity of a cylinder bore in an example of a single-ended swash plate compressor in which the piston assemblies are supported at both the front and rear ends. In the figure, a cylinder assembly 51 is formed by joining a front cylinder block 51*a* and a rear cylinder block 51*b*. A swash plate chamber 52 is formed in the center of the cylinder assembly 51, and cylinder bores 61, 62 are formed in the front cylinder block 51*a* and the rear cylinder block 51*b*, respectively, around the swash plate chamber 52. The cylinder bores 61, 62 are formed in a plurality of pairs, each having the same diameter and being disposed equidistantly in a circle of prescribed radius around a drive shaft 63, and the cylinder bores 61 in the front cylinder block 51*a* each have the same center as the corresponding cylinder bores 62 in the rear cylinder block 51*b*. Housings are disposed at the end of the front cylinder block 51*a* and the end of the rear cylinder block 51*b*, respectively, and are fastened by bolts, but in this figure, only part of the housing 53 at the front end is shown.

Piston assemblies 55, which are housed in the cylinder bores 61, 62 comprise: guide pistons 55*b*, which are formed on the front end of piston rods 55*a*; and compression pistons 55*c*, which are formed on the rear end of the piston rods 55*a*. Each of the piston assemblies 55 has a swash plate engaging portion 55*d* in the center of the piston rod 55*a*, and a pair of shoe receivers 55*e* formed in the swash plate engaging portion 55*d* engage a pair of shoes 58, and thus engage a swash plate 57 by means of the shoes 58.

The front cylinder bores 61 normally connect to the inner chamber of the housing 53, which is connected to the intake side, and the rear cylinder bores 62 connect to the discharge side and the intake side through discharge valves and intake valves, which are not shown. The clearance between the guide pistons 55*b* and the front cylinder bores 61 (hereinafter called "side clearance") and the side clearance between the compression pistons 55*c* and the rear cylinder bores 62 are formed to the same dimensions.

The drive shaft 63 is supported rotatably by radial bearings 64, 65 in the center of the cylinder blocks 51*a*, 51*b*. A boss portion 57*a* is secured to the swash plate 57 in the center of the drive shaft 63. Thrust bearings 66, 67 are disposed between the boss portion 57*a* and the cylinder blocks 51*a*, 51*b* and support the load in the axial direction of the swash plate 57.

Consequently, in this single-ended swash plate compressor, when the drive shaft 63 is driven by an external power source, the swash plate 57 rotates and reciprocates, and the piston assemblies 55 are made to reciprocate within the cylinder bores 61, 62 by means of the shoes 58. At this time, the piston assemblies 55 are guided by the guide pistons 55*b* and the compression pistons 55*c*, and the compression pistons 55*c* compress the refrigerant gas inside the cylinder bores 62.

However, in the single-ended swash plate compressor employing this method of supporting the piston assemblies 55 at both the front and rear ends, it is difficult to avoid manufacturing problems, such as the cylinder bores 61, 62 being deformed by the fastening of the housings (53, etc.) to the cylinder blocks 51*a*, 51*b* by the bolts or by the pressure of the refrigerant gas charged in the compressor, or, as shown in FIG. 5 (in order to explain misalignment of the axes, the side clearance and misalignment of the axes in this figure are slightly exaggerated), the center lines 61A of the front cylinder bores 61 and the center lines 62A of the rear cylinder bores 61 being out of alignment with respect to the center lines 55A of the cylinders on the plans for the piston assembly 55. For that reason, when trying to reduce the side clearance which is formed between the pistons 55*c* and the cylinder bores 62 in order to reduce blowback and increase compression efficiency, there is a risk that partial interference will occur between the pistons 55*b*, 55*c* and the cylinder bores 61, 62 due to the kind of deformation and misalignment of the axes of the cylinder bores 61, 62 mentioned above, or that the work required to cause the pistons to reciprocate will increase, or that friction and abrasion will occur in the interfering portions.

SUMMARY OF THE INVENTION

The present invention aims to solve the above problems with the prior art and an object of the present invention is to provide a single-ended swash plate compressor with low mechanical loss, which does not allow increased blowback, and which easily avoids partial interference between the pistons and the cylinder bores.

To achieve the above objectives, in the invention according to claim 1, a single-ended swash plate compressor comprises: a cylinder assembly comprising a swash plate chamber internally disposed therein and pairs of cylinder bores formed around the swash plate chamber in the front end and the rear end thereof, respectively; a drive shaft centrally disposed in the cylinder assembly; piston assemblies comprising pistons formed on both ends of piston rods and which are housed in the plurality of pairs of cylinder bores; a swash plate housed in the swash plate chamber which rotates together with the drive shaft to cause the piston assemblies to reciprocate; and housings covering both ends of the cylinder assembly; wherein the pistons are guided in one set of cylinder bores and a compression action is performed by the pistons in an other set of cylinder bores, the inside of said cylinder bores being connected to the intake side by means of intake valves and to the discharge side by means of discharge valves, characterized in that a side clearance between the pistons and the cylinder bores in the one set of cylinder bores is made larger than a side clearance between the pistons and the cylinder bores in the other set of cylinder bores.

By using this construction, even if deformation or misalignment of the axes occurs in the cylinder bores due to stress acting during assembly of the compressor or due to stress resulting from the pressure of the refrigerant gas charged in the compressor, since the side clearance between the pistons and the cylinder bores in the one set of cylinder bores is larger than the side clearance between the pistons and the cylinder bores in the other set of cylinder bores, partial interference between the pistons and the cylinder bores is avoided and the pistons can reciprocate smoothly.

Moreover, if the side clearance between the pistons and the cylinder bores in the one set of cylinder bores and the side clearance between the pistons and the cylinder bores in the other set of cylinder bores are made in accordance with the invention according to claims 2 to 4, the pistons can be made to reciprocate even more effectively and smoothly.

Furthermore, if the diameters of the pistons and cylinder bores in the one set of cylinder bores are each made smaller than the diameters of the pistons and cylinder bores in the other set of cylinder bores, as in claim 5, the power consumed in driving the piston assembly is reduced and the power consumed by the compressor is therefore reduced.

DETAILED DESCRIPTION OF THE PREFERRED EMBODIMENTS

An actual embodiment of a single-ended swash plate compressor according to the present invention will now be explained with reference to FIGS. 1 to 3.

Figure 1:
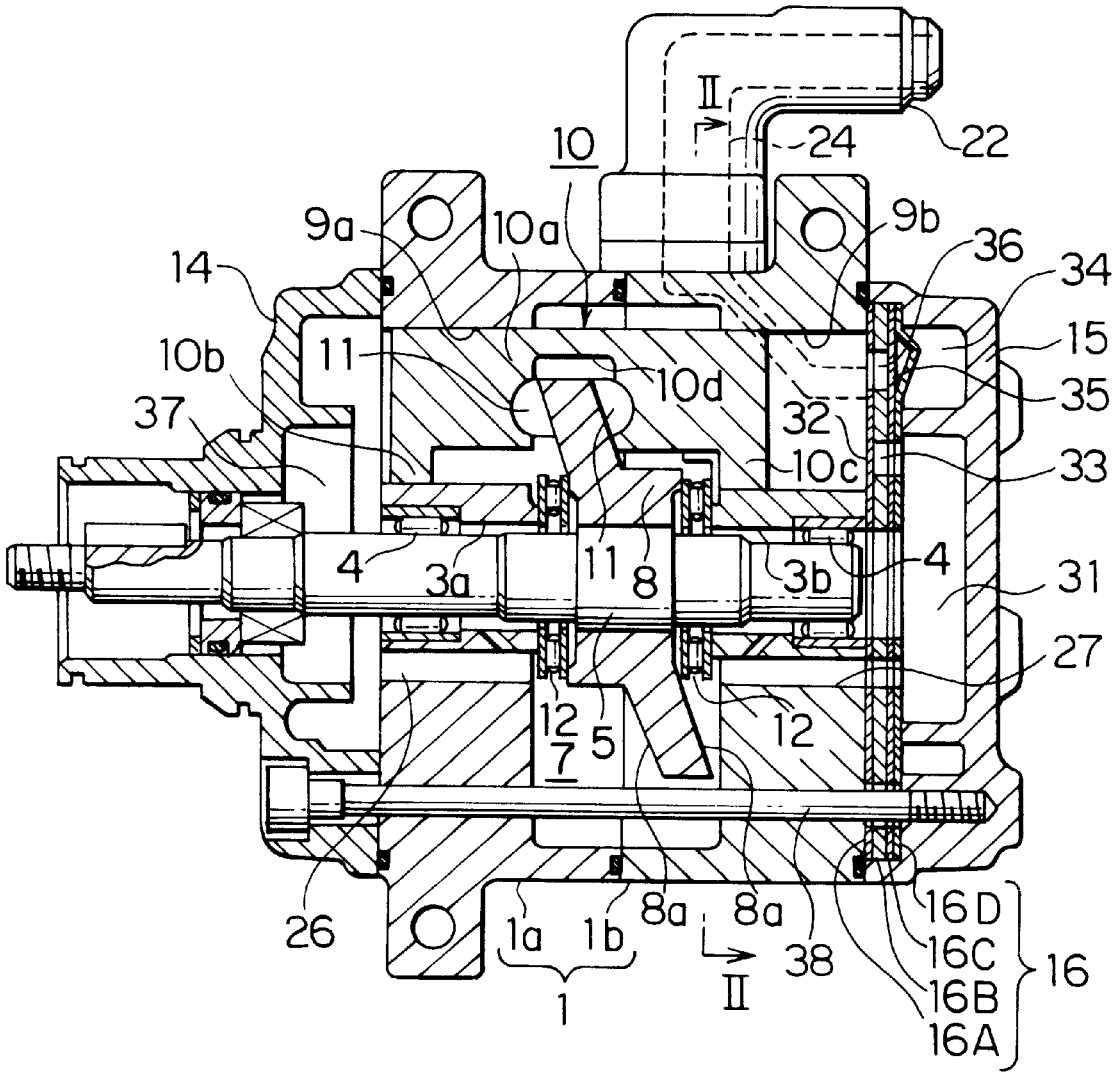
FIG. 1 is a vertical cross-section of a single-ended swash plate compressor according to an embodiment of the present invention.

FIG. 1 is a vertical cross-section of a single-ended swash plate compressor according to an embodiment of the present invention, and in the figure, a cylinder assembly 1 is formed by joining a front cylinder block 1*a* and a rear cylinder block 1*b*, with the rear end surface of the front cylinder block 1*a* being joined to the front end surface of the rear cylinder block 1*b*. A space is formed in the center of the cylinder assembly 1 between the cylinder blocks 1*a*, 1*b* when the cylinder block 1*a* is joined to the cylinder block 1*b*, and this space constitutes a swash plate chamber 7. As shown in FIG. 2, the swash plate chamber 7 connects to an intake passage 23, which is connected to an inlet 21.

Drive shaft openings 3*a*, 3*b* are formed in the center of the cylinder blocks 1*a*, 1*b*, respectively. A drive shaft 5 is disposed in the center of the cylinder assembly 1 and is rotatably supported by radial bearings 4, which are disposed in the drive shaft openings 3*a*, 3*b*.

A swash plate 8 is disposed the swash plate chamber 7 so as to be rotatable by the drive shaft 5, the boss portion of the swash plate 8 being fitted over and secured to the center of the drive shaft 5. Thrust bearings 12 are disposed between both sides of the boss portion of the swash plate 8 and the central inside end surfaces of the cylinder blocks 1*a*, 1*b* to support the load in the axial direction of the swash plate 8.

Five cylinder bores 9*a*, 9*b* are disposed equidistantly in a circle of prescribed radius around the drive shaft 5 in each of the cylinder blocks 1*a*, 1*b*. The cylinder bores 9*a* in the front cylinder block 1*a* and the cylinder bores 9*b* in the rear cylinder block 1*b* are disposed so as to form 5 pairs of cylinder bores, each pair having the same center. The cylinder bores 9*a* in the front end are guides, and the cylinder bores 9*b* in the rear end are for compression.

Piston assemblies 10 each comprise: a piston rod 10*a*; a guide piston 10*b*, which is formed on the front end of the piston rod 10*a*; and a compression piston 10*c*, which is formed on the rear end of the piston rod 10*a*. The piston assemblies 10 are disposed such that each of the guide pistons 10*b* is housed in a cylinder bore 9*a* in the front end, and each of the compression pistons 10*c* is housed in a cylinder bore 9*b* in the rear end. A swash plate engaging portion 10*d* with a portal-shaped cross-section in the axial direction is formed in the center of each of the piston rods 10*a*, and shoes 11 are engaged by these swash plate engaging portions 10*d*. The piston assemblies 10 are constructed so as to be engaged by the surface 8*a* of the swash plate 8 by means of these shoes 11 and to be reciprocated as the swash plate 8 rotates.

The front end surface of the cylinder assembly 1 constructed as described above is covered by a front housing 14. The rear end surface of the cylinder assembly 1 is covered by a rear housing 15 through a valve assembly 16, which comprises: an inlet valve plate 16A, in which inlet valves 32 are formed in one unit in positions corresponding to the rear cylinder bores 9*b*; a port plate 16B, which has intake ports 33 in positions corresponding to the inlet valves 32 and discharge ports 36 in positions corresponding to the rear cylinder bores 9*b*; a discharge valve plate 16C, in which discharge valves 3D are formed in one unit in positions corresponding to the discharge ports 36; and a retainer plate 16D, which has retainers which regulate the degree of opening of the discharge valves 35 formed in one unit. These housings 14, 15 are joined and secured to the cylinder assembly 1 by means of a plurality of bolts 38, which pass through the length of the cylinder assembly 1.

The inner chamber 37 of the front housing 14 is connected to the swash plate chamber 7 by means of a plurality of connecting passages 26, which are formed in the front cylinder block 1*a*. The front cylinder bores 9*a* are open to the inner chamber 37.

The inside of the rear housing 15 is divided into two concentric spaces by a dividing wall. The inner space forms an intake chamber 31, which connects to the swash plate chamber 7 by means of a plurality of connecting passages 27, which are formed in the rear cylinder block 1*b*. The intake chamber 31 connects to the rear cylinder bores 9*b* by means of the intake ports 32 and the intake valves 33. The outer space within the rear housing 15 forms a discharge chamber 34, which connects to each of the rear cylinder bores 9*b* by means of the discharge valves 35 and the discharge ports 36. The discharge chamber 34 is connected to an outlet 22 by means of discharge passages 24.

In a swash plate compressor of the above construction, when the drive shaft 5 is driven by an external drive source, such as a vehicle engine, etc., the rotational force of the drive shaft 5 is converted to reciprocating motion by the swash plate 8, which rotates and reciprocates, and is transmitted to the piston assemblies 10 by means of the shoes 11. The piston assemblies 10 are guided at both ends as they reciprocate by the sliding action of the guide pistons 10*b*, which are housed in the front cylinder bores 9*a*, and the compression pistons 10*c*, which are housed in the rear cylinder bores 9*b*. The compression of the refrigerant gas is performed in the rear cylinder bores 9*b* by the reciprocating motion of the piston assemblies 10.

That is, the refrigerant gas in an external refrigerant circuit (not shown) is taken in from the inlet 21, successively through the intake passage 23, the swash plate chamber 7, the connecting passages 27, the intake chamber 31, the intake ports 33, and the intake valves 32, to the cylinder bores 9*b*. The refrigerant gas taken into the cylinder bores 9*b* is compressed by the compression pistons 10*c*, pushes open the discharge valves 35, and is discharged from the discharge ports 36 to the discharge chamber 34. The gas discharged to the discharge chamber 34 is conveyed through the discharge passages 24 and the outlet 22 to the external refrigerant circuit.

Thus, in the rear cylinder bores 9*b*, compression of the refrigerant gas is performed and at the same time a guide action is performed to ensure smooth reciprocation of the piston assemblies 10, but in the front cylinder bore 9*a*, the cylinder bores 9*a* are connected to the intake side (the low-pressure side) by means of the intake passage 23, the swash plate chamber 7, the connecting passages 26, and the inner chamber 37 in the front housing 14, and they therefore function only to guide one end of the piston assemblies 10 without performing a compression action.

In a single-ended swash plate compressor which is constructed to operate in this manner, the side clearance $C_R$ between the pistons 10*c* and the cylinder bores 9*b* in the rear end is set at the smallest possible value, in a range that will not obstruct the sliding action of the pistons 10*c*, with the aim of reducing gas blowback and improving compression efficiency.

On the other hand, the side clearance $C_F$ between the pistons 10*b* and the cylinder bores 9*a* in the front end is set larger so that the pistons 10*b*, 10*c* can reciprocate smoothly even if deformation or misalignment of the axes occurs in the cylinder bores 9*a*, 9*b* due to stress imparted during fastening of the housings 14, 15 by the bolts 38 or due to the pressure of the refrigerant gas charged in the compressor.

Figure 3:
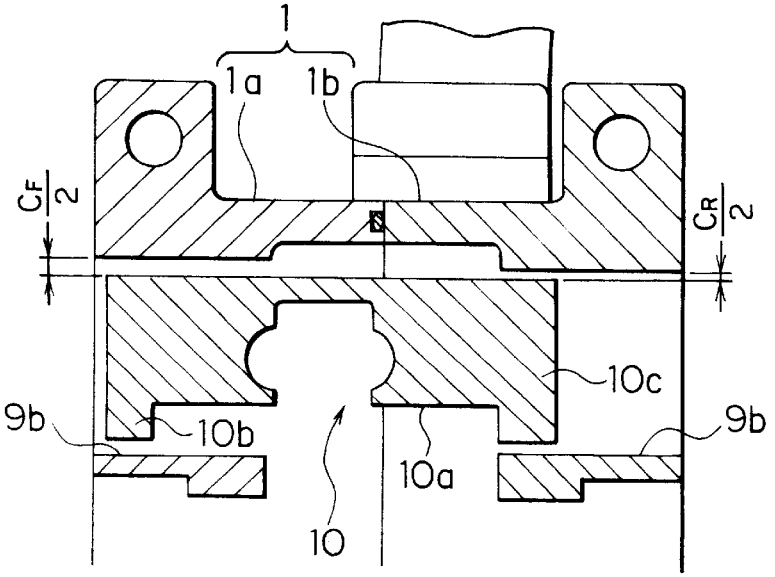
FIG. 3 is a diagram explaining the side clearance between the cylinder bores and pistons with the side clearance slightly exaggerated for clarity.
Figure 4:
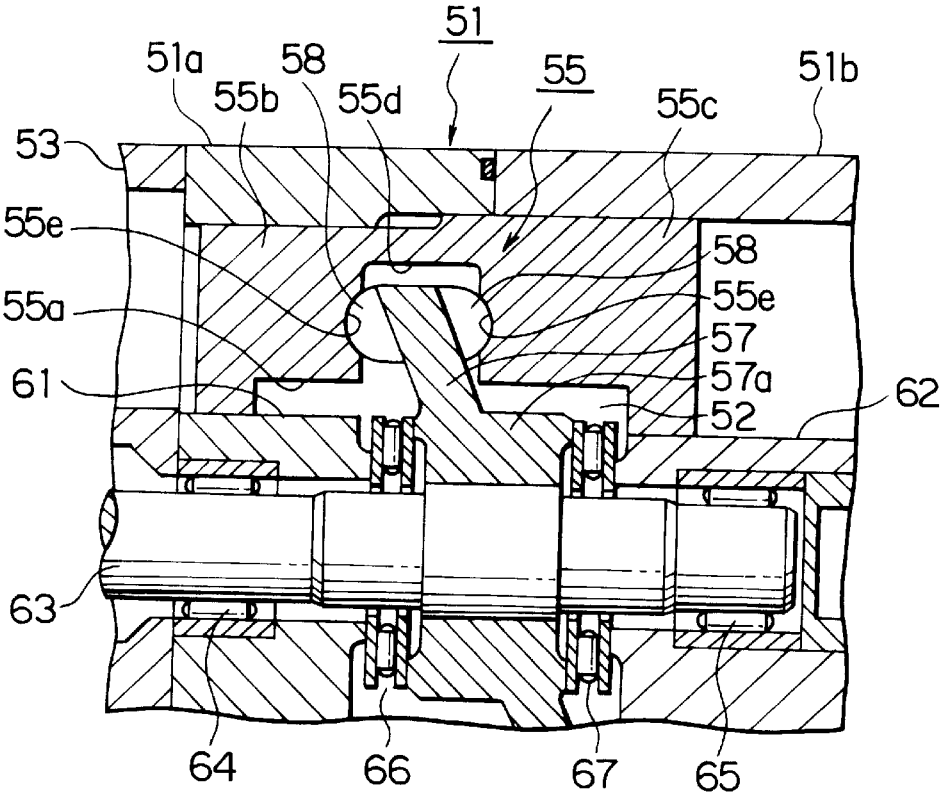
FIG. 4 is a partial cross-section of a conventional single-ended swash plate compressor.
Figure 5:
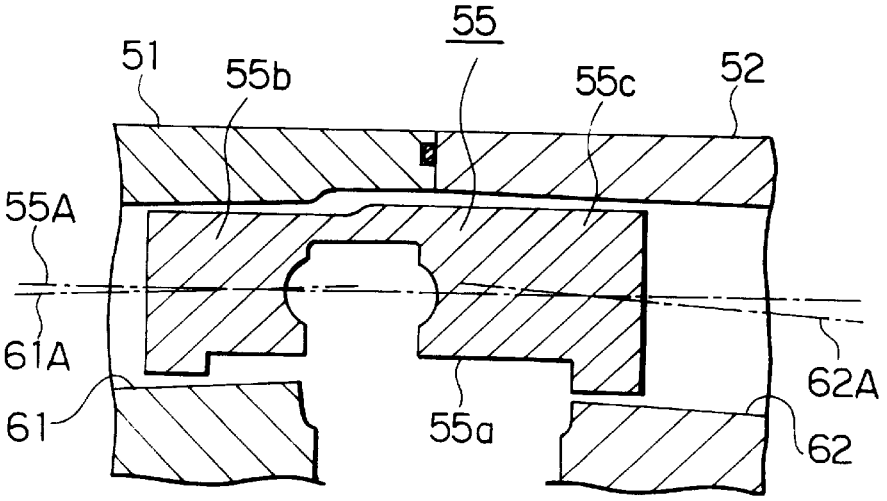
FIG. 5 is a diagram explaining misalignment of the axes of the cylinder bores in the conventional single-ended swash plate compressor in FIG. 4 with the side clearance and misalignment of the axes slightly exaggerated for clarity.

Specifically, the side clearance $C_F$ in the front end is formed approximately 2 to 10 times or approximately 10 to 100 $\mu$m larger than the side clearance $C_R$ in the rear end (see FIG. 3). Preferably, the side clearance $C_F$ in the front end should be approximately seven times that of the side clearance $C_R$ in the rear end and, for example, if the side clearance $C_R$ in the rear end is 5 $\mu$m, the side clearance $C_F$ in the front end should be 35 $\mu$m.

Consequently, partial interference between the pistons 10*b*, 10*c* and the cylinder bores 9*a*, 9*b* can be avoided by construction in this manner, and smooth reciprocation of the pistons can be obtained. Therefore, blowback of gas in the rear end and mechanical loss can both be reduced.

Figure 2:
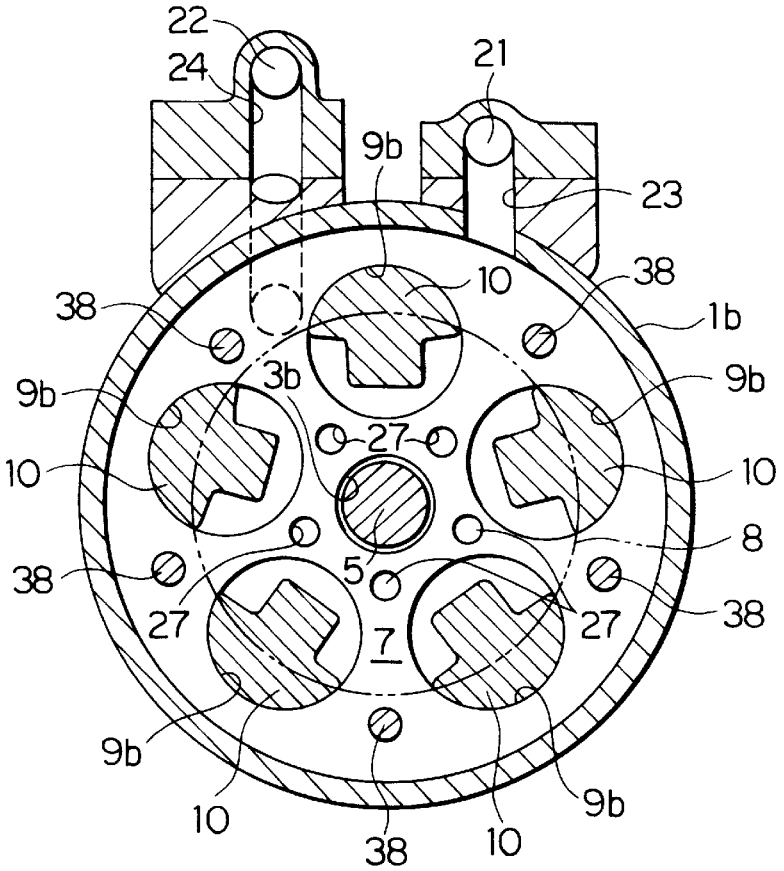
FIG. 2 is a cross-section taken along line II—II in FIG. 1.

The above is an explanation of an embodiment of the present invention with reference to FIGS. 1 to 3, but the pistons 10*b* and the cylinder bores 9*a* in the front end can be made smaller than the respective pistons 10*c* and cylinder bores 9*b* in the rear end. In so doing, the piston assemblies will become lighter, and the sliding surface area of the pistons 10*b* in the front end will be reduced, reducing sliding friction, and therefore power consumption.

Furthermore, although the single-ended swash plate compressor in the above embodiment is a fixed volume type, the invention is not limited to such a fixed volume type, and a variable volume type can also be used.

What is claimed is:

1. A single-ended swash plate compressor comprising:

a cylinder assembly, which comprises a swash plate chamber internally disposed therein and a plurality of pairs of cylinder bores formed in the front end and the rear end of said swash plate chamber, respectively, the pluralities of cylinder bores at the respective of said ends of said swash plate chamber constituting respective sets of cylinder bores;

a rotatable drive shaft centrally disposed in said cylinder assembly;

a corresponding plurality of piston assemblies each comprising respective pistons formed on both ends of respective piston rods and which are housed respectively in said pairs of cylinder bores;

a swash plate housed in said swash plate chamber which rotates together with said drive shaft to cause said piston assemblies to reciprocate within said cylinder bores;

and housing means covering both ends of said cylinder assembly;

wherein said pistons in one set of cylinder bores are guide pistons and said pistons in the other set of cylinder bores are compression pistons, the insides of said other set of cylinder bores being connected to an intake side of said compressor by means of intake valves and to a discharge side of said compressor by means of discharge valves, characterized in that a side clearance between each of said guide pistons and a corresponding one of said cylinder bores in said one set of cylinder bores is larger than a side clearance between each of said compression pistons and a corresponding one of said cylinder bores in said other set of cylinder bores.

2. The single-ended swash plate compressor according to claim 1, wherein said side clearance between each of said guide pistons and a corresponding one of said cylinder bores in said one set of cylinder bores is approximately 2 to 10 times said side clearance between each of said pistons and a corresponding one of said cylinder bores in said other set of cylinder bores.

3. The single-ended swash plate compressor according to claim 1, wherein said side clearance between each of said pistons and a corresponding one of said cylinder bores in said one set of cylinder bores is approximately 10 to 100 $\mu$m larger than said side clearance between each of said pistons and a corresponding one of said cylinder bores in said other set of cylinder bores.

4. The single-ended swash plate compressor according to claim 1, wherein said side clearance between each of said pistons and a corresponding one of said cylinder bores in said one set of cylinder bores is approximately 35 $\mu$m and said side clearance between each of said pistons and a corresponding one of said cylinder bores in said other set of cylinder bores is approximately 5 $\mu$m.

5. The single-ended swash plate compressor according to claim 1, wherein the diameters of said cylinder bores and the diameters of said guide pistons housed in said cylinder bores in said one set of cylinder bores are smaller than the diameters of said cylinder bores and the diameters of said compression pistons housed in said cylinder bores in said other set of cylinder bores.

6. The single-ended swash plate compressor according to claim 1, wherein at least said compression pistons and cylinder bores in said second set of cylinder bores are cylindrical in shape.

7. The single-ended swash plate compressor according to claim 6, wherein said guide pistons and cylinder bores in said first set of cylinder bores are cylindrical in shape.

8. The single-ended swash plate compressor according to claim 1, wherein said side clearance between each of said compression pistons and a corresponding one of said cylinder bores in said second set of cylinder bores is the smallest size which will permit sliding of the piston within said corresponding one of said cylinder bores while providing minimal gas blowback.

* * * * *